US010178886B2

(12) United States Patent
Braun

(10) Patent No.: US 10,178,886 B2
(45) Date of Patent: Jan. 15, 2019

(54) APPARATUS FOR POSITIONING RIBBONS, NAME TAGS, AND INSIGNIAS

(71) Applicant: Arnold Braun, Weston, FL (US)

(72) Inventor: Arnold Braun, Weston, FL (US)

(73) Assignee: Arnold Braun, Saint Petersburg, FL (US)

( * ) Notice: Subject to any disclaimer, the term of this patent is extended or adjusted under 35 U.S.C. 154(b) by 165 days.

(21) Appl. No.: 15/155,052

(22) Filed: May 15, 2016

(65) Prior Publication Data

US 2017/0325529 A1 Nov. 16, 2017

(51) Int. Cl.
*A41D 29/00* (2006.01)
*A44C 3/00* (2006.01)

(52) U.S. Cl.
CPC ..... *A41D 29/00* (2013.01); *A44C 3/002* (2013.01)

(58) Field of Classification Search
CPC ..... A41D 29/00
USPC ..... 33/653
See application file for complete search history.

(56) References Cited

U.S. PATENT DOCUMENTS

| | | | | | |
|---|---|---|---|---|---|
| 2,387,986 | A * | 10/1945 | Evans | A41H 1/02 | 33/653 |
| 2,821,787 | A * | 2/1958 | Shepard | A41D 29/00 | 33/653 |
| 4,302,884 | A * | 12/1981 | Pallone | A44C 3/002 | 33/562 |
| 7,637,028 | B2 * | 12/2009 | Allen | B25H 7/00 | 33/563 |
| 8,590,169 | B2 * | 11/2013 | Holmquist | G09F 21/02 | 33/563 |
| 2003/0213140 | A1 * | 11/2003 | Burt, Jr. | A41H 3/002 | 33/653 |
| 2006/0137229 | A1 * | 6/2006 | Jordan | A44C 3/002 | 40/1.6 |
| 2017/0325529 | A1 * | 11/2017 | Braun | A41D 29/00 | |

* cited by examiner

*Primary Examiner* — Yaritza Guadalupe-McCall

(57) ABSTRACT

An apparatus for properly displaying ribbons, name tags, insignias, and badges on a garment; wherein predetermined arrangements of awards can be quickly and reliably established using a plurality of labeled holes, slots and measurements in a template. Military, police, firefighters, and other civil uniformed organizations use name tags, ribbons, awards, and insignias on their shirt, blouse, jackets, and head cover to display name, rank, and awards. This invention introduces an easy to use way to properly apply name tags, ribbons, awards, badges, pins, and insignias at predetermined positions in the template for military and civil uniformed services. This template will make it easier and quicker to accurately apply the said items to uniform garments with the use of predetermined holes, slots, and etched markings.

15 Claims, 7 Drawing Sheets illustrates the back view of the apparatus.

Each hole and slot is labeled with either a letter or a corresponding uniform item it relates to.

FIG.1 illustrates the front view of the apparatus.

Stainless steel, metal, and or plastic rectangular shape card
Size: 90mm by 50mm
Thickness:0.5mm to 0.75mm FIG.2 illustrates the back view of the apparatus.

Each hole and slot is labeled with either a letter or a corresponding uniform item it relates to.

FIG. 3 illustrates the apparatus being used to place a breast insignia over top of a ribbon bar on a uniform item FIG. 4 illustrates the placement of a breast insignia into the apparatus using corresponding holes that are labeled FIG. 5 illustrates the apparatus being used to place a rank insignia on a head cover FIG. 6 illustrates the apparatus being used to place a rank insignia on the collar of a uniform shirt FIG. 7 illustrates the apparatus being used to place a rank insignia on the collar of a uniform shirt

APPARATUS FOR POSITIONING RIBBONS, NAME TAGS, AND INSIGNIAS

CROSS REFERENCE TO RELATED APPLICATIONS

This application claims the benefit of provisional patent application Ser. No. 62/188,525, filed on 2015 Jul. 3 by present inventor.

STATEMENT REGARDING FEDERALLY SPONSORED RESEARCH OR DEVELOPMENT

Not Applicable

SEQUENCE LISTING OR PROGRAM

Not Applicable

BACKGROUND OF INVENTION

Field of Invention

This invention relates to uniform tools, specifically to uniform tools for use with military and civil uniformed service personnel to help aide in the placement of uniform item

Prior Art

| REFERENCES CITED | | | |
|---|---|---|---|
| 61/470,419 | March 2011 | DAVIGNON | |
| 4,302,884 | December 1981 | PALLONE | 33/180 |
| 2,387,986 | November 1945 | EVENS | 510,693 |

All branches of the military, police forces, security and other civil uniformed organizations use name tags, ribbons, awards, and insignias on their uniform to display rank or identifying marks. The name tags and awards are required to be mounted in a designated location and to be within standards of their organization's uniform manual. Putting together a proper uniform takes a lot of time to measure and place the awards where they are intended to be on the uniform. Other inventors have created several types of uniform tools which help place insignias on a uniform garment but they are only designed for the use of one insignia, mostly collar devices, or they are another form of a ruler where the user needs to keep measuring each item for their uniform to ensure it is in its proper location. Each inventor falls short at creating a template that is used for all uniform Items on all uniform garments.

U.S. Pat. No. 61/470,419; entitled "Collar Insignia Gauge" issued Mar. 31, 2011; utilized open ended slots for easy removal of the collar insignia along with a bisecting line for alignment but it did not incorporate all the insignias needed for use with a complete uniform. Furthermore, this patent is for use with Navy and only focuses on the Navy rank insignia located on a shirt collar. This design also uses an open ended slot whereas my design uses a closed slot so that the device will not bend or break.

U.S. Pat. No. 4,302,884; entitled "Insignia Positioning Template" issued Dec. 1, 1981; utilized open ended slots for easy removal and added alignment marks and a stud for stabilizing the template. With this design, it only focuses on one aspect of your uniform and falls short when it comes to the rest of your uniform accoutrements. This device does not account or easy storage in a wallet and houses a protruding stud whereas my device is flat and rectangular in shape.

U.S. Pat. No. 2,387,986; entitled "Insignia Positioning Device" and issued Oct. 30, 1945; discloses a flat, plastic, transparent, rectangular device with rectangular openings for inserting insignia there through and with line graduations marked thereon for ruler-like measuring and aligning the openings in accord with the promulgated positioning rules. When an opening is positioned, the insignia may be inserted through the opening for attaching the insignia to the uniform. The device may thereafter be lifted over the insignia without disturbing the attached and positioned insignia. Furthermore, this device is only used for the collar device of one set uniform for Officers and it does not encompass all the insignias, ribbons, nametag, and medals for the other uniforms or ranks.

There is a need for a compact easy to use all-in-one template to quickly and accurately apply these said garments to a uniform. For the military, the uniform regulations printed wording and pictured examples are confusing and conflicting at times. As a military member, I have to obey and enforce these standards. I created this uniform template to meet the need of applying name tags, ribbons, medals, awards, and insignias quickly and accurately using a polarity of predetermined holes, slots, and markings so that you do not have to measure each item.

Accordingly, there exists a need for an all-in-one apparatus to assist in the accurate placement and positioning of ribbons, name tags, insignias, badges, collar devices, and rank insignias on a uniform garment, where the use of measuring each item is at a minimum.

This design is comprised of a small rectangular shaped template measuring 90 mm by 50 mm.

This apparatus also includes predetermined holes, slots, and etched measurements and markings to help accurately and quickly apply name tags, ribbons, medals, badges, breast insignias, pins, and rank insignias to a garment without having to measure each said item. This apparatus sits on top of the uniform garment either over the pocket of a shirt or jacket, on the shirt collar, shoulder boards, or on the head cover. The template is used to help aide in the placement of uniform apparel that is required for all military, police, firefighters, and civil uniformed services to display. With this all-in-one template, the member is able to place the device on any one of their issued uniform garments and then press all their corresponding awards, medals, ribbons, collar devices, name tags, and rank insignias into one of the predetermined slots or holes without having to measure each item for accuracy. This all-in-one uniform template will be the only tool needed to help perfectly place all uniform accoutrements onto said garments.

BRIEF SUMMARY OF THE INVENTION

The uniform template design depicted in the figures is for use on all military and civil service uniforms. The use of this uniquely designed apparatus will aide in the proper alignment of name tags, ribbons, medals, insignias, and collar devices; while applying them to the uniform. This is an effective invention that is simple, accurate and easy to use. This template can also be used as a measuring device for uniform inspections by using the etched measurements that are predetermined on the device. While the design for one military branch is illustrated in this patent, many variations may be made in alignment marks, holes, and wording for all other branches and civil uniform services, without departing from the spirit of this patent. Thus, the drawings in this embodiment are depicted as illustrative and the scope of these claims should not be limited to the example described and shown herein, rather by the appended claims and their legal equivalents.

BRIEF DESCRIPTION OF THE DRAWINGS

FIG. 2*a* illustrates a closed ended slot used to place an insignia on a garrison cover.

FIG. 2*b* illustrates an etched and or painted reference line which shows a measurement that corresponds to uniform regulations manuals of all military branches and civilian uniformed services.

FIG. 2*c* illustrates an etched and or painted letter which corresponds to a hole where an insignia will be placed.

FIG. 2*d* illustrates a hole in the apparatus where the pins of each uniform item will be placed.

FIG. 2*e* illustrates an etched and or painted line with a measurement attached for the purpose of aligning the insignias on the uniform.

FIG. 6*a* illustrates a rank insignia being placed into the apparatus for proper placement on a shirt collar.

DETAILED DESCRIPTION AND BEST MODE OF IMPLEMENTATION

Figure 1:
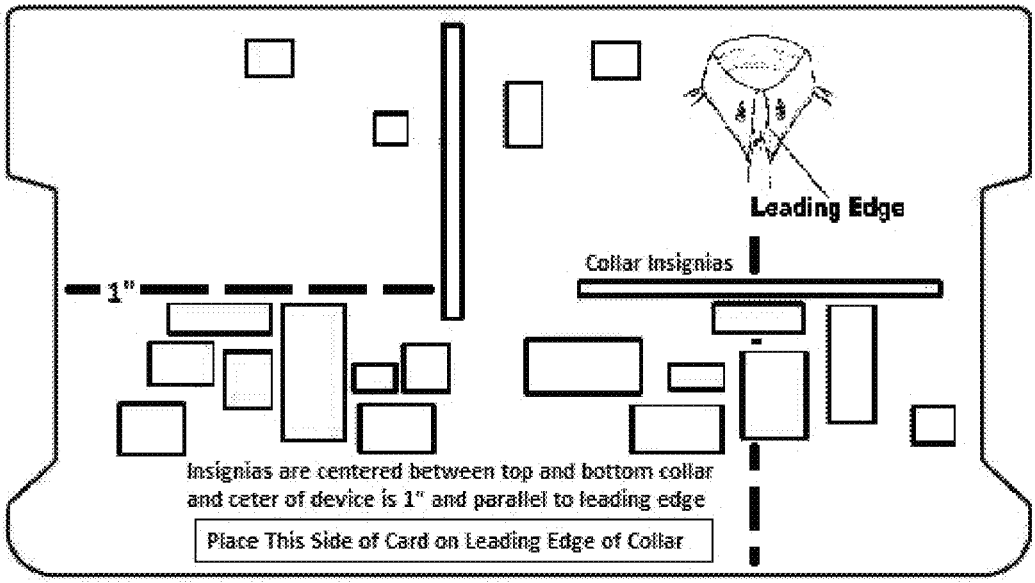
FIG. 1 shows the front view of the apparatus depicting the general layout and features of the template.
Figure 2:
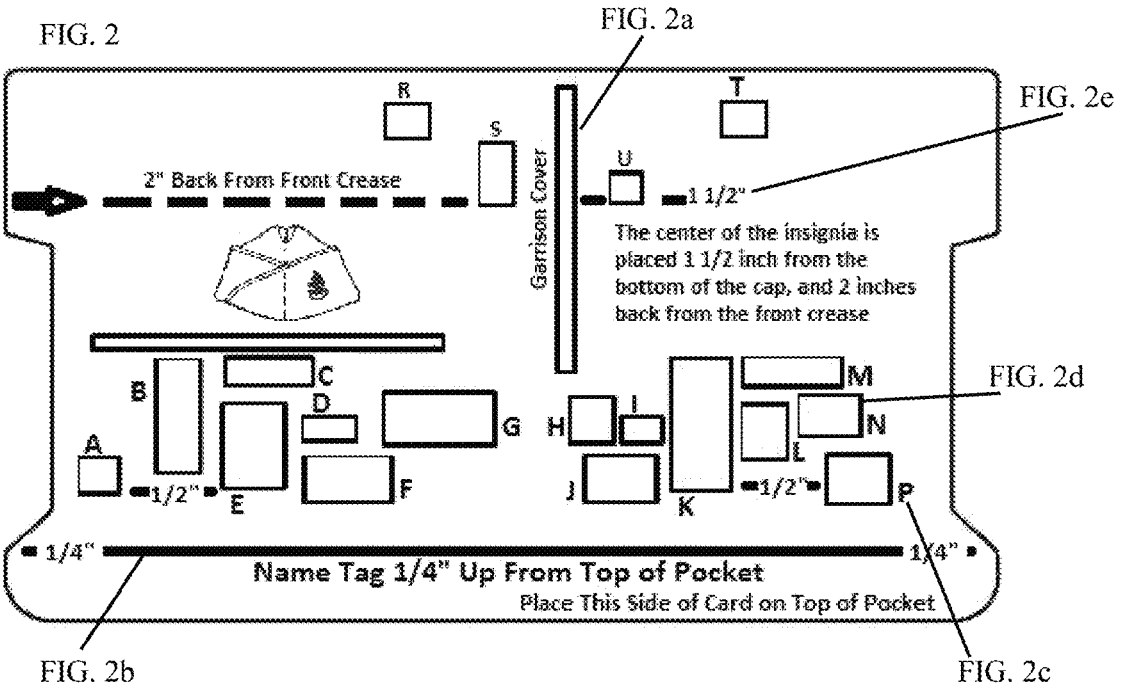
FIG. 2 illustrates the back view of the apparatus depicting the general layout and the features.
Figures 3, 3A:
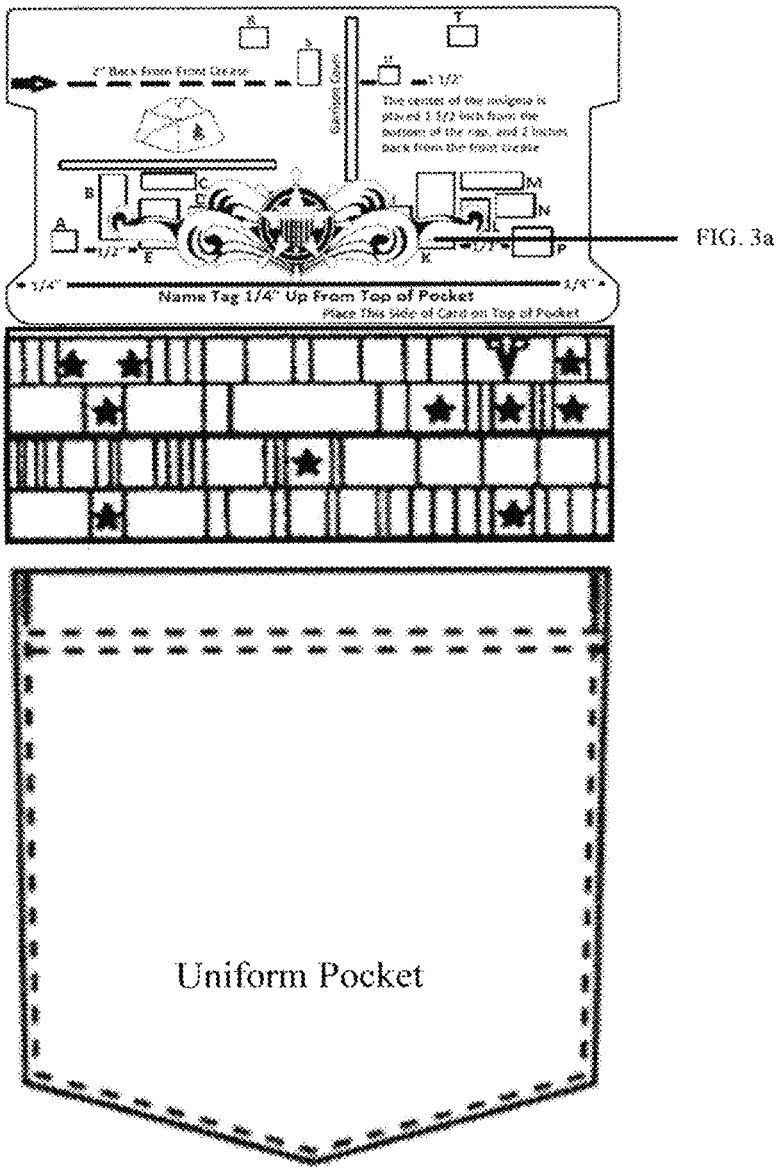
FIG. 3 illustrates the apparatus being used to place a breast insignia over top of a ribbon bar on a uniform item.
FIG. 3*a* shows a breast insignia placed on the apparatus where the bottom of the insignia is resting on the reference line.
Figures 4, 4A:
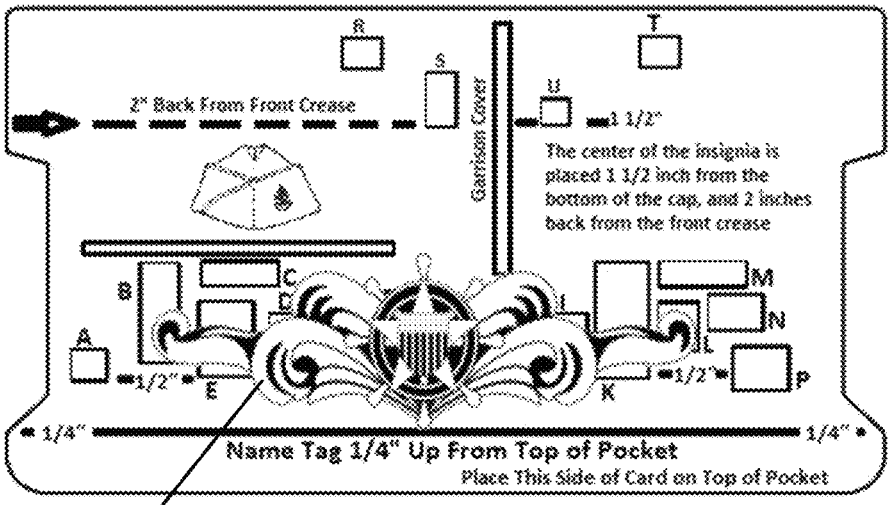
FIG. 4 illustrates the placement of a breast insignia into the apparatus using corresponding holes that are labeled.
FIG. 4*a* depicts a breast insignia being placed on the apparatus where the pins of the insignia are protruding through the apparatus into corresponding holes.
Figures 5, 5A:
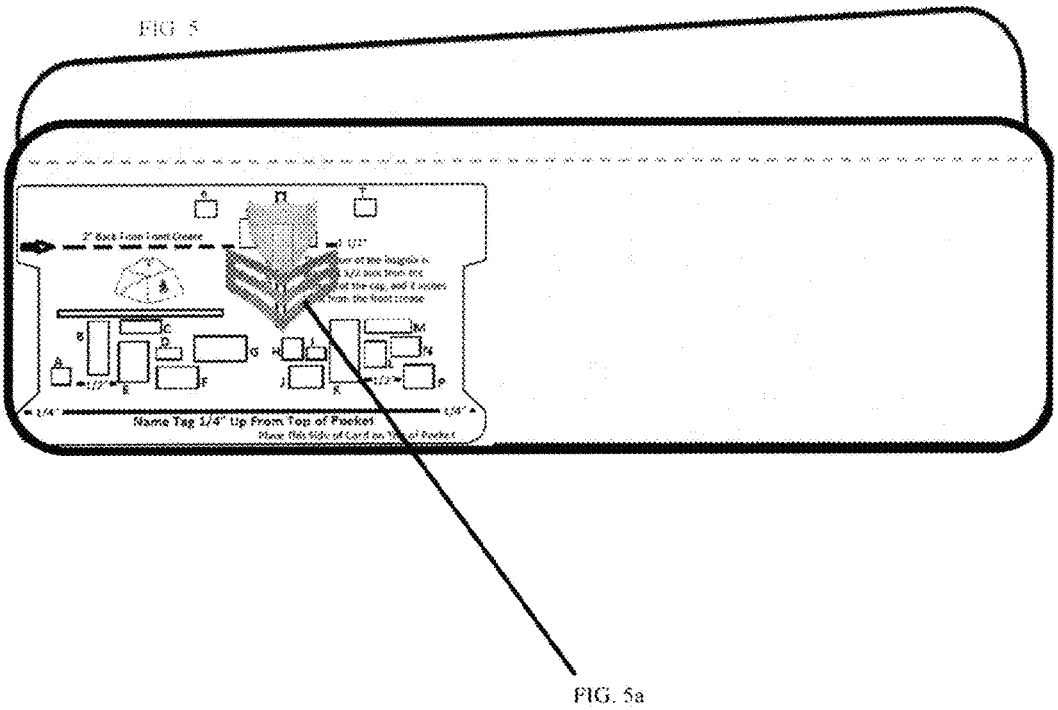
FIG. 5 illustrates the apparatus being used to place a rank insignia on a head cover.
FIG. 5*a* shows a rank insignia being placed into the apparatus to show proper placement on a head cover.
Figure 6:
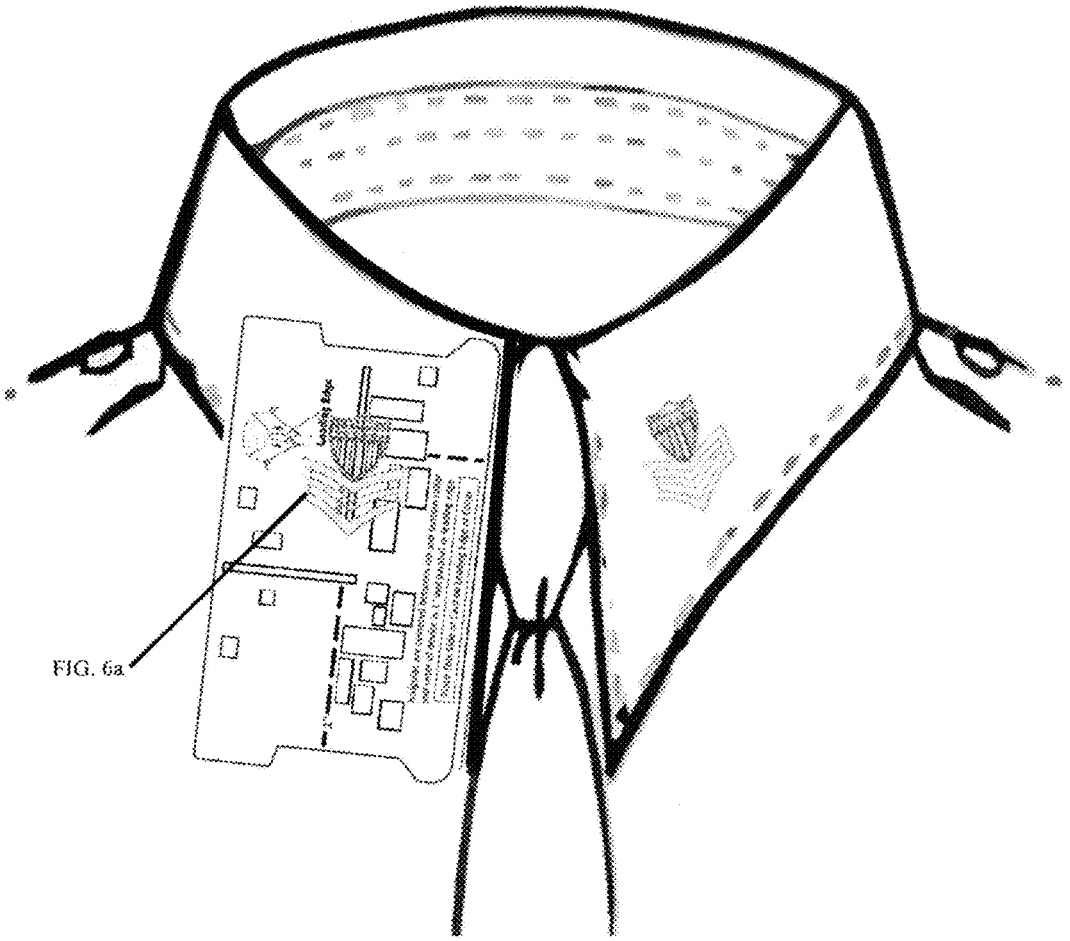
FIG. 6 illustrates the apparatus being used to place a rank insignia on the collar of a uniform shirt.
Figures 7, 7A:
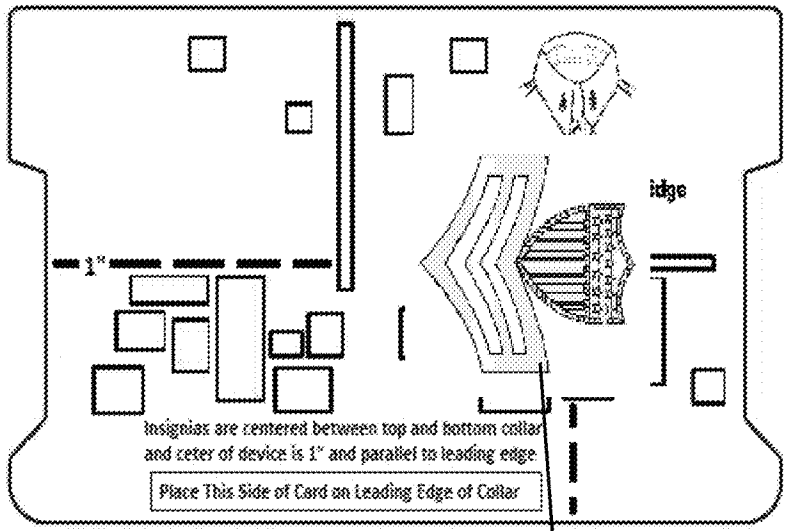
FIG. 7 illustrates the apparatus being used to place a rank insignia on the collar of a uniform shirt.
FIG. 7*a* illustrates a rank insignia being used on the apparatus.

The said apparatus contained herein will be rectangular in shape measuring 90 mm by 50 mm with a thickness of 0.5 mm to 0.75 mm and be constructed out of either stainless steel, metal, and or plastic material. It will consist of a variation of holes, slots, etched measurements, and markings as per FIG. 1 and FIG. 2 which will be in precise locations so that the apparatus is in compliance with all regulation manuals for each military branch, police, fire, rescue, and all other civil uniformed services.

The apparatus will consist of at least one labeled hole that is either square, rectangular or circle in shape (FIG. 2*d*). It will also consist of at least one slot (FIG. 2*a*), one etched or inked measurement line related to the corresponding labeled holes (FIG. 2*e*), and one etched or inked marking that correspond to each hole or slot (FIG. 2*c*). These requirements will be used for the guidance and placement of any and all items that need to be attached to a uniform garment.

The Template device is used on the outside of the uniform garment where one would place the apparatus over top of the garment and then position the devices to be attached into one of the labeled holes or slots that are on the template. Refer to FIGS. 3, 4, 5, 6, and 7 of the illustrations for the placement of the template over a uniform garment. This apparatus helps align where the uniform devices are supposed to be placed as per the uniform manuals of each organization (FIG. 3*a*, FIG. 4*a*, FIG. 5*a*, FIG. 6*a*, FIG. 7*a*). Every line, hole, measurement, and markings are predetermined to help properly place all uniform accoutrements where they need to be. The embodiment of this apparatus includes a plurality of labeled holes (FIG. 2*d*), slots (FIG. 2*a*), and measurements in a predetermined distance, as well as a measured reference line (FIG. 2*b*) to help aide in the placement and mounting of name tags, ribbons, medals, breast insignias, badges, pins, and rank insignias on a uniform garment.

The invention claimed is:

1. An apparatus to properly and accurately align all military and civil service ribbons, name tags, insignias, pins and badges to the outer side of a uniform blouse, jacket, garment, and head cover, said apparatus consisting of a small rectangular body, with a differing front and back side, at least one labeled hole that is either square, or rectangular in shape labeled with a letter correspondent to each uniform item; at least one slot, one etched measurement line related to the corresponding labeled holes, and one etched marking that correspond to each hole or slot; wherein every line, hole, measurement, and markings is predetermined to help properly place all uniform accoutrements where they need to be and minimizes the measuring of each said items to ensure it is properly mounted in its correct location.

2. The apparatus as set forth in claim 1 wherein: the embodiment is constructed of stainless steel, metal, and or plastic and small in size and shape so that the apparatus could be stowed in a wallet for quick and easy access when needed.

3. The apparatus as set forth in claim 1 wherein; the embodiment includes, a plurality of labeled markings, measurements, holes, slots and cutouts on the front and back side which are placed in a predetermined location to help aide in the proper placement and mounting of a name tag, ribbon bar, awarded medals, badges, collar devices, and insignias onto the outside of a uniform garment.

4. The apparatus set forth in claim 1 wherein; labeled holes, and markings are applied on the apparatus in predetermined locations to help properly and accurately affix a name tag and ribbon bar over the top of a blouse or jacket pocket.

5. The apparatus set forth in claim 1 wherein: the embodiment includes at least one reference line composed of either a solid, dashed, or dotted line labeled with a measurement of either ⅛", ¼", ½", ¾", 1", 1½", 2", 2½" and is used to help properly place an awarded medal, ribbon bar, and name tag over top of a uniform pocket as well as art accompanied badge, breast insignia, collar device, rank insignia, and other uniform accoutrements onto the uniform in their precise location as set forth in the service members uniform manual.

6. The apparatus as set forth in claim 1 wherein: resting the apparatus on top of the uniform garment will help aide in the proper placement of uniform items without the need to measure each item for accuracy.

7. The apparatus as set forth in claim 1 wherein: the apparatus can be specifically made and tailored with variations, alignments, marks, and wording for each branch of the military as well as police, fire, rescue, and any and all other civil uniformed services without departing from the spirit of this patent.

8. The apparatus as set forth in claim 1 wherein: the construction of the apparatus is all inclusive and the embodiment will have cutouts, slots, measurements, and markings to ensure that the apparatus will help properly affix not one or two uniform items but all uniform devices needed for a member to display a proper uniform.

9. A small compact all in one apparatus used for proper placement of any and all ribbons, name tags, insignias, badges, collar devices, rank insignias, pins and medals on the outside of a uniform garment, whereas the apparatus consists of a variety of holes and slots that are premeasured and precisely placed onto a front side and back side of the apparatus; at least one labeled hole that is either square, or rectangular in shape labeled with a letter correspondent to each uniform item; and one etched marking that correspond to each hole or slot; wherein every hole and slots is predetermined to help properly place all uniform accoutrements.

10. The apparatus as set forth in claim 9 wherein: the said apparatus can be used on all garments of a uniform to help aide in the proper placement of all ribbons, name tags, insignias, badges, collar devices, and medals and is not limited to one uniform device or one uniform garment but constructed to be an all-inclusive apparatus so that it will help the user properly place all their awarded devices onto all of there uniforms.

11. The apparatus as set forth in claim 9 wherein: the apparatus includes at least one cutout for the proper placement of a breast insignia or badge to be located on the front side of the uniform shirt or jacket.

12. The apparatus as set forth in claim 9 wherein: the apparatus includes at least one slot and one cutout to help aide in the proper placement of a collar device on a member's shirt and service jacket.

13. The apparatus as set forth in claim 9 wherein: the apparatus includes a labeled slot and marking located either on the front or back of the apparatus to be used to properly place a rank insignia on a military or civil service members head cover.

14. A single all in one apparatus that helps with alignments and placements of all awarded military and civil devices, said apparatus consisting of a body with a differing front and back side which comprises different size holes and slots, measurement lines and reference points; at least one labeled hole with a letter correspondent to each uniform item used to properly affix an array of military awarded devices onto the front side of a uniform above the shirt and jacket pocket as well as the shirt and jacket collar and head cover without the need for measuring the awarded device for accuracy.

15. The apparatus as set forth in claim 14 wherein: the embodiment consists of at least one reference line which is labeled with a standard U.S. measurement as well as holes and slots that are prepositioned and labeled on the apparatus to help aide in the correct placement of said devices as per the uniform regulations of each military and civil service uniform manual.

* * * * *